US006190143B1

(12) United States Patent
Jacobsen et al.

(10) Patent No.: US 6,190,143 B1
(45) Date of Patent: Feb. 20, 2001

(54) PISTON PUMP WITH ZERO TO NEGATIVE CLEARANCE VALVE

(75) Inventors: Stephen C. Jacobsen; Clark C. Davis, both of Salt Lake City; Michael G. Morrison, West Jordan; Marc Oliver, Sandy, all of UT (US)

(73) Assignee: Sarcos L.C., Salt Lake City, UT (US)

( * ) Notice: Under 35 U.S.C. 154(b), the term of this patent shall be extended for 0 days.

(21) Appl. No.: 09/420,294

(22) Filed: Oct. 18, 1999

(51) Int. Cl.[7] ..... F04B 17/00
(52) U.S. Cl. ..... 417/570; 417/501
(58) Field of Search ..... 417/570, 501

(56) References Cited

U.S. PATENT DOCUMENTS 4,125,176 * 11/1978 Thrasher, Jr. ..... 184/39.1
5,253,984 * 10/1993 Gruett et al. ..... 417/401
5,638,920 * 6/1997 Gruett ..... 184/7.4
6,071,097 * 6/2000 Gruett et al. ..... 417/553

* cited by examiner

*Primary Examiner*—Charles G. Freay
*Assistant Examiner*—Robert Z. Evora
(74) *Attorney, Agent, or Firm*—Thorpe, North & Western, LLC

(57) ABSTRACT

An improved piston-type vacuum pump comprises a reciprocating piston disposed within a cylinder having a proximal end and a distal end, an inlet port formed in the side of the cylinder near the proximal end, and a spring-biased outlet valve, such as a poppet valve or a rocker valve, disposed at the distal end of the cylinder. The piston stroke is configured to provide zero or negative clearance between the piston head and the face of the outlet valve at the end of the compression stroke. The piston reciprocates within the cylinder from a first position wherein the surface of the piston head is proximal of the inlet port, to a second position wherein the surface of the piston head is beyond the distal end of the cylinder, so as to contact the face of the outlet valve in its open position. The piston top and outlet valve face remain in contact until the piston has retracted into the distal end of the cylinder, allowing the valve to seal the distal end of the cylinder prior to the beginning of the expansion stroke, such that there is substantially no dead volume within the cylinder at the beginning of the expansion stroke.

22 Claims, 2 Drawing Sheets

PISTON PUMP WITH ZERO TO NEGATIVE CLEARANCE VALVE

BACKGROUND OF THE INVENTION

1. Field of the Invention

This invention relates to piston-type vacuum pumps. More particularly, the present invention relates to an improved piston-type vacuum pump with a zero or negative clearance valve for allowing more complete evacuation of the vacuum chamber, and hence more efficient pumping.

2. State of the Art

Piston-type vacuum pumps are well known. Such pumps typically comprise a reciprocating piston disposed within a cylinder, the cylinder having inlet and outlet ports or valves. Uncompressed air is drawn into an evacuated cylinder through an inlet port, then compressed and forced to flow out through an outlet valve by the forward motion of the piston. As the piston retracts, the outlet valve closes, allowing the retraction of the piston to create a vacuum within the cylinder. When the piston reaches or passes the inlet port, the vacuum formed within the cylinder draws gas into the cylinder, and the process repeats itself.

However, one drawback of typical piston-type vacuum pumps is that the cylinder never completely evacuates at the end of the compression cycle. When the piston extends to the forward position, clearances between component parts allow a small amount of gas to remain in the cylinder. For example, if the pump utilizes a pressure activated outlet valve, such as a spring-loaded valve, some residual pressure will normally remain in the cylinder when the valve closes because a minimum pressure is required to open the valve in the first place due to the spring-biased configuration. Additionally, the clearance between the end of the piston and the inside of the end of the cylinder or outlet valve normally defines a volume of space in which some air will naturally remain.

In order to create a piston-type vacuum pump with increased vacuum pressure capability, it would be desirable to have a piston pump configured to allow no residual gas to remain in the cylinder after.compression. It would also be desirable to have a piston-type vacuum pump which requires very low power to operate.

OBJECTS AND SUMMARY OF THE INVENTION

It is therefore an object of the present invention to provide a piston-type vacuum pump that is simple in design and operation.

It is another object of this invention to provide a compact piston-type vacuum pump with increased vacuum capability.

It is still another object of the invention to provide a compact piston-type vacuum pump which operates at very low power.

It is yet another object of the invention to provide a spring-biased poppet valve which allows full escape of compressed gas from a pump cylinder, without allowing any gas to flow back into the cylinder before resealing.

The above and other objects are realized in a low power piston-type vacuum pump having zero or negative clearance between the piston head and the inside of the cylinder/outlet valve at the end of the compression stroke. The pump comprises a reciprocating piston disposed within a cylinder having a proximal end and a distal end, an inlet port formed in the side of the cylinder near the proximal end, and a spring-biased outlet valve disposed at the distal end of the cylinder. The outlet valve may be either a poppet type valve, or a rocker valve. The piston is configured to reciprocate within the cylinder from a first position wherein the top end of the piston is proximal of the inlet port, to a second position wherein the top end of the piston extends beyond the distal end of the cylinder, so as to contact the face of the outlet valve in its open position. The piston top and valve face remain in contact until the piston has retracted into the distal end of the cylinder, allowing the valve to seal the distal end of the cylinder prior to the beginning of the expansion stroke.

These and other objects are also realized in an embodiment of a piston-type vacuum pump having a pair of oppositely oriented cylinders with encased pistons operating in tandem. The coupled piston pairs allow the pump to achieve very low power operation. Alternatively, a single piston with a sealed motor may also be used to achieve low power operation. Other objects and features of the present invention will be apparent to those skilled in the art, based on the following description, taken in combination with the accompanying drawings.

DETAILED DESCRIPTION OF THE PREFERRED EMBODIMENT

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
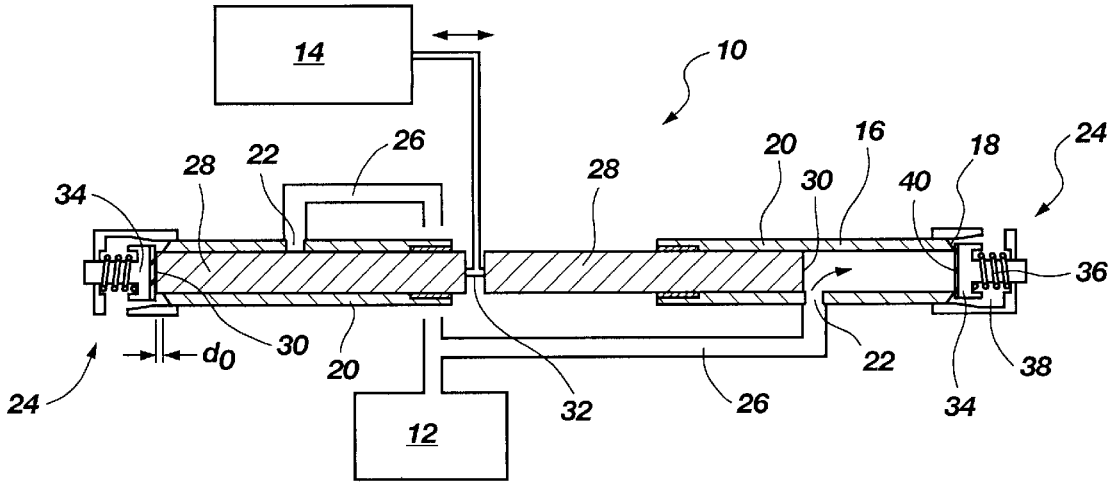
FIG. 1 shows a cross-sectional view of the piston-type vacuum pump system configured in a tandem, dual-piston arrangement.

FIG. 1 provides a cross-sectional view of the invention with the piston vacuum pump 10 configured in a tandem, dual-piston arrangement. The pump system generally comprises the pump 10, a gas source 12, and a reciprocating drive means 14. The gas source 12 is depicted as a closed vessel, but it will be apparent that the vacuum pump disclosed herein may be connected to other devices or left open to the atmosphere or used in any other manner common to vacuum pumps.

The pump 10 generally comprises a cylinder 16 having a distal end 18 and a proximal end 20. In the tandem arrangement of FIG. 1, both pistons may be disposed within opposite ends of a single cylinder, or within two separate but generally axially aligned cylinders. Disposed in the cylinder wall near the proximal end 20 is an inlet port or valve 22, and an outlet valve is disposed on the distal end 18 of the cylinder. In the embodiment of FIG. 1, the outlet valve comprises a spring-biased poppet valve 24. Conduit 26 connects the vessel to be evacuated 12 to the inlet port 22. A reciprocating piston 28 having a flat piston head 30 is slidably disposed within the cylinder 16, and is connected to the opposing piston by means of linkage 32, which in turn is connected to reciprocating drive means 14.

Poppet valve 24 is generally comprised of a poppet 34, and spring biasing means 36, contained within a poppet cavity 38. The poppet valve 24 may be constructed without a poppet cavity, having instead a direct connection to the outside atmosphere. The spring biasing means 36 is preferably a coil spring, though other types of springs may be used. The poppet 34 has a flat head or face 40, which is provided with a resilient material 42, such as a thickness of rubber, to cushion the contact between the end of the piston and the poppet face, and to provide an air-tight seal. The distal end of the cylinder 18 is provided with a knife edge seal 44 extending around the perimeter thereof, and the poppet 34 is configured such that the poppet face 40 is normally held by the spring biasing means 36 in a closed position with the resilient face material 42 pressed snugly against the distal end 18 of the cylinder, against the knife edge seal 44 (FIG. 1, right side).

Figure 2:
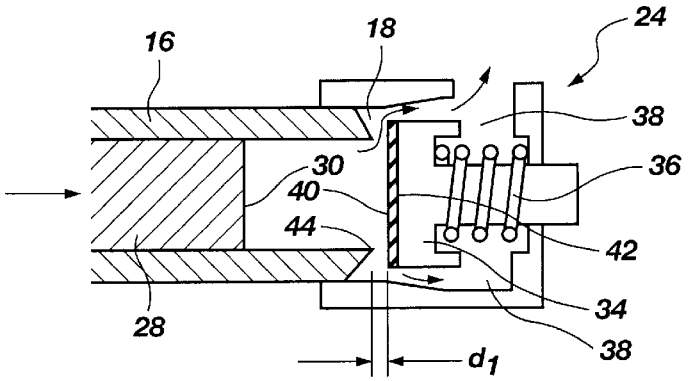
FIG. 2 shows a closeup view of the end of the piston and open poppet valve during part of the compression phase.
Figure 4:
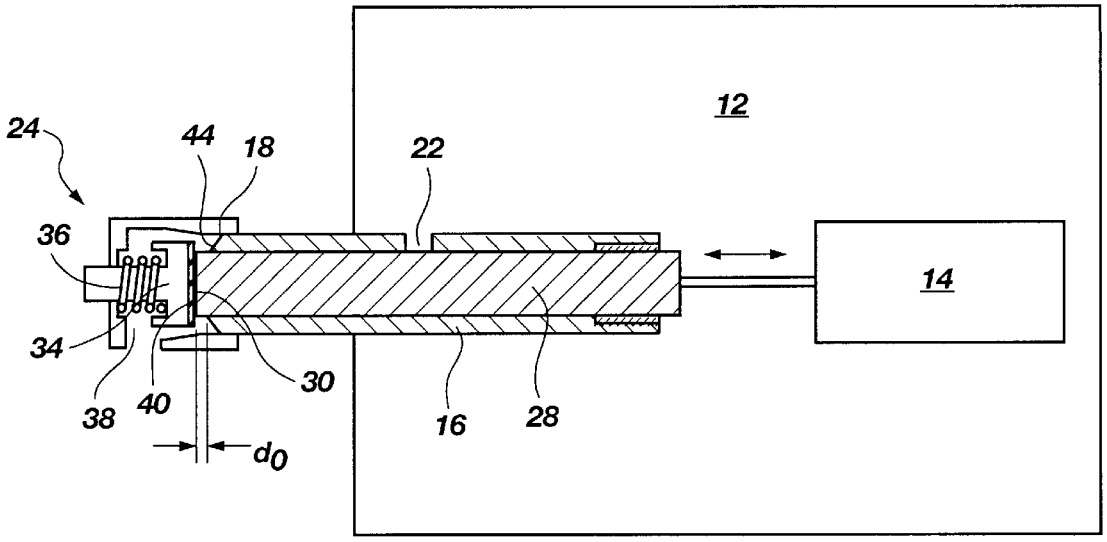
FIG. 4 shows a cross-sectional view of an alternative embodiment of the piston-type vacuum pump system configured in a sealed motor/single piston arrangement.
Figure 5:
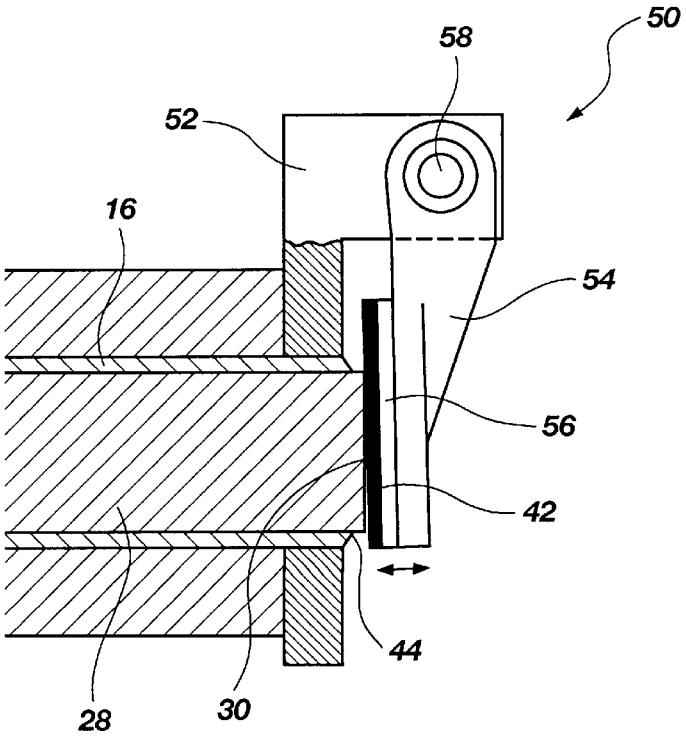
FIG. 5 shows an alternative embodiment of the outlet valve comprising a rocker valve.

The configuration of the knife edge seal 44 is more clearly visible in the close-up view of FIG. 2, and also in FIGS. 4 and 5. This seal generally comprises a bevel or knife edge formed on the distal end 18 of the cylinder, extending around the perimeter thereof. The soft surface of the resilient face material 42 deforms when the poppet face 40 presses against the knife edge 44, providing an air tight seal between the poppet and the distal end 18 of the cylinder. It will be apparent that the knife-edge seal could be oppositely formed, with the poppet face comprising a hard, annular, knife-edge protrusion formed therein, and an annular ring of soft, resilient material disposed on the distal end of the cylinder. This alternative arrangement is not preferred, however, because of the probable cost and difficulty of forming the parts as described, and because it probably would not function as well as the preferred embodiment described above. Likewise, the resilient face material 42 could be disposed on the distal end of the piston, rather than on the poppet, to cushion the contact between piston and poppet.

The poppet cavity 38 is normally open to the atmosphere, and extends distally from the distal end 18 of the cylinder. As noted above, the poppet valve could be configured with a conduit leading to atmosphere, rather than a poppet cavity. In the open position, shown in FIG. 2, the poppet 34 is disposed away from contact with the knife edge seal 44, allowing gas to escape from the cylinder, through the poppet cavity 38, and to the atmosphere.

Rather than a poppet valve, the outlet valve could be configured as a rocker valve, as depicted in FIG. 5. In this configuration, the pump is generally configured the same as in the poppet valve embodiment, with knife edge seal 44 formed on the distal end of cylinder 16, in which piston 28 reciprocates. Instead of poppet valve 24, however, a rocker valve 50 is provided. Rocker valve 50 generally comprises a frame 52 disposed about the distal end of the cylinder, to which a rocker 54 having a rocker face 56 is attached at pivotal connection 58. As with the poppet valve, rocker face 56 is preferably provided with a resilient face material to cushion the contact between piston end 30 and the rocker face 56. Pivotal connection 58 is spring-biased, and configured to keep rocker 54 in a normally closed position, with rocker face 56 sealed snugly against the knife edge seal 44, as with the poppet valve.

Figure 3:
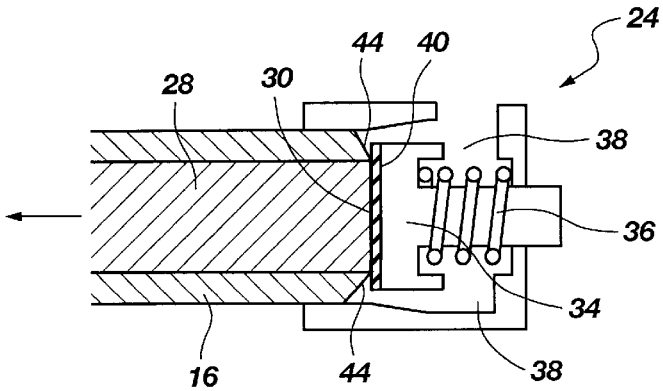
FIG. 3 shows a closeup view of the end of the piston and poppet valve at the moment the valve closes at the beginning of the expansion phase.

FIGS. 2 and 3, taken together with FIG. 1, illustrate the four basic phases of operation of the pump 10. Phase 1 is shown on the right side of FIG. 1, wherein the poppet valve 24 is fully closed and sealed, and piston 28 is in the fully retracted position, with the piston head 30 retracted beyond the inlet port 22. In this position, air is allowed to flow into the cylinder through the inlet port 22. Phase 2, the compression phase, is shown in FIG. 2. In this phase, the piston moves forward, past the inlet port 22, and begins to compress the gas in the cylinder. In the initial stage of phase 2, the poppet valve 24 remains closed. However, as the piston moves forward and compresses the gas, at some point the pressure will become sufficient to force the poppet valve 24 to open some distance $d_1$. This condition is shown in FIG. 2, wherein the poppet 34 is at least partially retracted into the poppet cavity 38 against the spring biasing means 36, allowing gas to escape out the distal end of the cylinder, and into the poppet cavity.

Phase 3 of the operation of the pump is shown on the left side of FIG. 1, and in FIG. 4. The piston 28 is advantageously configured to have a stroke which extends the piston head 30 some distance $d_0$ beyond the distal end 18 of the cylinder 16, and into the poppet cavity 38. As the gas in the cylinder is compressed in phase 2, the piston eventually travels past the distal end 18 of the cylinder and extends into the poppet cavity while the poppet is open. Eventually, the flat piston head 32 comes in direct, flush contact with the face 40 of the open poppet 34. This is the "zero" clearance condition mentioned, and is shown in FIG. 1, left side. As the piston 28 begins to retract, beginning the expansion phase, or phase 4, the poppet is biased against the piston head by the spring biasing means such that the resilient face of the poppet retracts in concert with the piston head, and closes and seals against the knife edge seal while still in contact with the piston head. This is phase four, and is shown in FIG. 3.

FIG. 3 provides a closeup view of the end of the piston and poppet valve at the moment the valve closes at the beginning of the expansion phase. By virtue of this configuration, there is zero clearance between the piston head and the face of the poppet valve (which defines the distal end of the cylinder 18) at the end of the compression phase/beginning of the expansion phase. Consequently, the pump is able to produce a stronger vacuum because the zero clearance configuration allows essentially no gas to remain within the cylinder at the beginning of the expansion phase. The piston retracts within the cylinder until it extends past the inlet port 22 to the beginning of the cycle. With the cylinder evacuated, air is rapidly drawn into the cylinder through the inlet port 22, and the cycle repeats itself.

It will be apparent that the same series of operational phases applies to the rocker valve embodiment depicted in FIG. 5, except that the rocker valve 50 will pivot, rather than deflect linearly, due to pressure and contact with the piston at the end of the compression stroke. However, the same advantages of zero or negative clearance are provided because the very slight angular rotation of the rocker face 56 away from the and of the piston will disappear by the time the rocker valve closes and contacts the knife edge seal at the beginning of the expansion stroke.

It will also be apparent to one skilled in the art that the piston stroke and/or dynamic properties of the spring biasing means for either the poppet or rocker may be adjusted so as to selectively modify the timing and force of contact between the piston head and the poppet/rocker face. For example, the piston could be configured to extend to meet the poppet/rocker face before the end of its stroke, and actually push the valve further open before retracting in concert therewith, such that $d_0$ (FIG. 1 left side, FIG. 4) is a larger distance than $d_1$, (FIG. 2). This configuration is termed a "negative" clearance system because the piston stroke extends the piston beyond the open position of the valve. Alternatively, the spring biasing means could be configured to open the valve beyond the point of maximum extension of the piston head during the compression phase, then push the poppet/rocker face to meet the piston head approximately at the moment retraction begins, such that $d_0$ is smaller than $d_1$.

In operation, the piston may reciprocate at speeds of from 1 to 5000 cycles per second. In the preferred embodiment, however, the pump is designed to operate at a speed of about 30–60 cycles per second. The reciprocating drive means 14 may be any means capable of providing the required reciprocation, but is preferably a miniature DC electric motor, such as model 1016 manufactured by Micro Mo Electronics, Inc. of Clearwater, Fla. The motor is preferably provided with an assembly, such as a crank and drive rod, for converting rotational motion into linear reciprocation. The motor may also have a gear reduction assembly for attaining the proper rotational output speed. An electric motor as described requires approximately ¼ watt to drive a pump having a 3 to 4 mm diameter piston. As an alternative to an electric motor, however, it will be apparent that any means suitable for producing the required power and reciprocation speed may be used, such as a solenoid, a hydraulic or pneumatic piston, etc.

It will be appreciated that the left hand and right hand portions of the pump 10 as shown in FIG. 1 are mirror images of each other, and that the pump 10 could be comprised of a single piston rather than the dual tandem piston arrangement shown. FIG. 4 shows a cross-sectional view of an alternative embodiment of the piston-type vacuum pump system configured in a single piston and sealed motor arrangement. In this embodiment, the pump 10 comprises a single piston and poppet valve 24 as described above, with the proximal end of the cylinder and drive means 14 disposed within the vacuum chamber 12. The inventors have discovered that this configuration results in a five-fold reduction in power required to operate the pump. With the motor sealed within a low pressure reservoir, the pump requires only enough power to provide the pressure differential between the evacuated cylinder and the pressure in vacuum chamber 12. This is because the exposed proximal end of the piston need not work against atmospheric pressure air as it retracts in the expansion phase, but instead against the reduced pressure within chamber 12.

It will be apparent that the same or similar power reduction benefits could be achieved by alternative arrangements. For example, instead of enclosing the motor and proximal end of the cylinder within the vessel to be evacuated, the proximal end of the cylinder could be enclosed and communicate with the vessel to be evacuated via a conduit to provide a vacuum therein. In this configuration an air-tight seal would be required in the proximal end of the cylinder around the reciprocating drive shaft to prevent leakage therearound. It will also be apparent that the embodiment of FIG. 4 may be configured with either a poppet valve or rocker valve.

The dual tandem cylinder arrangement of FIG. 1 may also be configured with the drive means and proximal ends of the cylinders enclosed within a vacuum chamber. However, it will be apparent that this embodiment also provides significant power reduction simply by virtue of its construction. With the proximal ends of tandem pistons linked to each other, the complementary reciprocation of these pistons does not fight against atmospheric pressure, whether enclosed within a single continuous cylinder or having separate axially aligned cylinders. Accordingly, the only power required is that related to the expansion within one cylinder and the concurrent compression within the other, which power requirement would exist in any case.

It will be apparent that multiple dual cylinder pumps as described above may be connected to a single drive means and/or connected in series or parallel to provide any desired vacuum pumping configuration. For example, two dual piston pumps may be connected in parallel, with one pump connected to a drive means 90° out of phase with the other. Because the pistons of a single dual cylinder are 180° out of phase with each other, the combined system will have a compression phase four times per cycle rather than twice, providing smoother operation and more constant vacuum pressure. Naturally, other arrangements and combinations may also be devised to provide even smoother operation if desired.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A piston-type vacuum pump, comprising:

a) a cylinder having a distal end;

b) a reciprocating piston with a piston head, disposed within the cylinder, having a compression and expansion stroke, the piston head having a cross-section which substantially completely fills the cross-section of the cylinder so as to substantially completely displace all fluid from the cylinder during the compression stroke; and c) an outlet valve disposed at the distal end of the cylinder and in fluid communication with an interior thereof, and configured to provide zero to negative clearance between the piston head and the valve, whereby the cylinder will contain substantially no dead volume at a beginning of the expansion stroke.

2. The vacuum pump as described in claim 1, further comprising inlet means disposed near a proximal end of the cylinder, configured for allowing gas to flow from outside the cylinder to the interior thereof.

3. The vacuum pump as described in claim 2, further comprising:

a) a face on the outlet valve;

b) the piston being moveable from a first position wherein the piston head is disposed proximal of the inlet means to at least a second position wherein the piston head is beyond the distal end of the cylinder and in contact with the outlet valve face, the motion of the piston from the first position to the second position being called a compression stroke, and the motion of the piston from the second position back to the first position being called an expansion stroke; and d) wherein the outlet valve is configured to open to allow gas to escape from the cylinder during the compression stroke, and to close while the valve face is in contact with the piston head at the beginning of the expansion stroke.

4. The vacuum pump as described in claim 3, wherein the valve face further comprises a resilient material disposed thereon to resiliently cushion the contact between the piston head and the valve face.

5. The vacuum pump as described in claim 2, further comprising a vessel to be evacuated in communication with the inlet means.

6. The vacuum pump as described in claim 1, wherein the outlet valve is moveable from a first closed position, wherein the valve face is snugly disposed against the distal end of the cylinder to provide an airtight seal, and a second open position, wherein the valve face is separated from the distal end of the cylinder allowing gas to escape therefrom.

7. The vacuum pump as described in claim 6, wherein the outlet valve is normally resiliently biased in a closed position.

8. The vacuum pump as described in claim 1, wherein the outlet valve is selected from the group comprising poppet valves and rocker valves.

9. The vacuum pump as described in claim 8, wherein the outlet valve comprises a poppet valve, the poppet valve further comprises a poppet chamber into which the poppet generally linearly retracts when opening, and into which the piston head extends at the end of the compression stroke.

10. The vacuum pump as described in claim 8, wherein the outlet valve comprises a rocker valve, the rocker valve further comprising:

a) a rocker having a rocker face; and b) wherein the rocker is pivotally connected adjacent the distal end of the cylinder, and configured to rotate about said pivotal connection from a first closed position, wherein the rocker face is snugly disposed against the distal end of the cylinder to provide an airtight seal, and a second open position, wherein the rocker face is separated from the distal end of the cylinder, allowing gas to escape therefrom.

11. The vacuum pump as described in claim 1, further comprising seal means formed between the distal end of the cylinder and the valve face, whereby an airtight seal may be formed between the valve face and the distal end of the cylinder when the valve is closed.

12. The vacuum pump of claim 11, wherein the valve face further comprises a resilient material disposed thereon, and the seal means comprises a hard knife-edge contact surface formed on the distal end of the cylinder around the perimeter thereof, which forms an airtight seal when the resilient valve face material presses there against.

13. The vacuum pump as described in claim 1, further comprising a drive means for causing linear reciprocal motion of the piston within the cylinder between the first and second positions.

14. The vacuum pump as described in claim 13, wherein a proximal end of the piston is disposed within a reduced pressure environment so as to reduce the power required to move the piston during the expansion phase.

15. The vacuum pump as described in claim 14, further comprising:

inlet means disposed near a proximal end of the cylinder, configured for allowing gas to flow from outside the cylinder to the interior thereof;

a vessel to be evacuated in communication with the inlet means; and wherein the proximal end of the cylinder, the drive means, and the inlet means are contained within a vessel to be evacuated.

16. The vacuum pump as described in claim 13, wherein said drive means is configured to cause said piston to reciprocate at a speed of from 1 to 5000 cycles per second.

17. The vacuum pump as described in claim 1, further comprising:

a) a second cylinder having a distal end;

b) a second reciprocating piston, disposed within the second cylinder, having a compression and expansion stroke; and c) a second outlet valve, disposed at the distal end of the second cylinder and in fluid communication with an interior thereof, configured to provide zero to negative clearance between an end of the piston and the outlet valve at the end of the compression stroke, whereby the second cylinder will contain substantially no dead volume at a beginning of the expansion stroke.

18. The vacuum pump as described in claim 17, further comprising:

a) drive means for causing simultaneous linear reciprocal motion of the first piston and second piston within the first and second cylinders, respectively; and b) wherein the first piston will be at the end of its compression stroke when the second piston is at the end of its expansion stroke, and the second piston will be at the end of its compression stroke when the first piston is at the end of its expansion stroke.

19. The vacuum pump as described in claim 18, further comprising:

a) linkage means for connecting a proximal end of the first piston to a proximal end of the second piston, and for connecting the pistons to the drive means; and b) wherein the first and second cylinders are generally axially aligned in a generally linear tandem arrangement with oppositely oriented pistons and oppositely oriented distal ends, such that motion of the first piston through its compression stroke causes the second piston to move through its expansion stroke, and motion of the second piston through its compression stroke causes the first piston to move through its expansion stroke.

20. A vacuum pump comprising:

a) an elongate cylinder enclosing an interior space and having a proximal end, a distal end, and an inlet means disposed near the proximal end, said inlet means configured for allowing gas to pass from outside the cylinder to the interior space thereof;

b) an outlet valve disposed on the distal end of the cylinder, said outlet valve having a face and being moveable from a first closed position wherein the face is snugly disposed against the distal end of the cylinder so as to provide an airtight seal, and a second open position wherein the face is separated from the distal end of the cylinder allowing gas to escape therefrom;

c) a piston slidably disposed within the cylinder, said piston having a piston head with a cross-section which substantially completely fills the cross-section of the cylinder;

d) reciprocal drive means for causing linear reciprocal motion of the piston from a first position wherein the piston head is disposed proximal of the inlet means to at least a second position wherein the piston head is beyond the distal end of the cylinder and in contact with the outlet valve face, the motion of the piston from the first position to the second position being called the compression stroke, and the motion of the piston from the second position back to the first position being called the expansion stroke, the piston head substantially completely displacing all fluid from the cylinder during the compression stroke; and e) wherein said outlet valve is configured to open to allow gas to escape from the cylinder during the compression stroke, and to close while in contact with the piston head at the beginning of the expansion stroke, such that the pump will have substantially no dead volume within the cylinder at the beginning of the expansion stroke of the piston.

21. The vacuum pump as described in claim 20, wherein the outlet valve is selected from the group comprising poppet valves and rocker valves.

22. The vacuum pump as described in claim 20, further comprising:

a) a vessel to be evacuated; and b) wherein the proximal end of the cylinder, the reciprocal drive means, and the inlet means are contained within the vessel to be evacuated.

* * * * *

UNITED STATES PATENT AND TRADEMARK OFFICE

CERTIFICATE OF CORRECTION

PATENT NO. : 6,190,143 B1
APPLICATION NO. : 09/420294
DATED : February 20, 2001
INVENTOR(S) : Stephen C. Jacobsen et al.

It is certified that error appears in the above-identified patent and that said Letters Patent is hereby corrected as shown below:

Column 1, line 3, insert the following Government Interest statement:

--Statement of Government Rights
This invention was made with government support under DABT63-97-C-0066 awarded by DARPA Department of Defense Advanced Research Projects Agency. The government has certain rights in the invention.--

Signed and Sealed this
Twentieth Day of December, 2011

David J. Kappos

David J. Kappos
*Director of the United States Patent and Trademark Office*